US005924699A

United States Patent [19]

Airey et al.

[11] Patent Number: 5,924,699

[45] **Date of Patent: *Jul. 20, 1999**

[54] TURBINE BLADE PLATFORM SEAL

[75] Inventors: David Airey, Pelham, N.H.; Natalie A. Pelland, Tolland; David P. Houston, Glastonbury, both of Conn.

[73] Assignee: United Technologies Corporation, Hartford, Conn.

[ * ] Notice: This patent is subject to a terminal disclaimer.

[21] Appl. No.: 08/772,962

[22] Filed: Dec. 24, 1996

[51] Int. Cl.[6] ..... F16J 15/02; F01D 11/02

[52] U.S. Cl. ..... 277/411; 416/193 A; 416/248; 416/500

[58] Field of Search ..... 277/411, 412; 416/193 A, 248, 500

[56] References Cited

U.S. PATENT DOCUMENTS

| | | | |
|---|---|---|---|
| 3,112,915 | 12/1963 | Morris | 253/77 |
| 3,610,778 | 10/1971 | Suter | 416/210 |
| 3,751,183 | 8/1973 | Nichols et al. | 416/220 |
| 3,887,298 | 6/1975 | Hess et al. | 416/220 |
| 4,101,245 | 7/1978 | Hess et al. | 416/190 |
| 4,183,720 | 1/1980 | Brantley . | |
| 4,455,122 | 6/1984 | Schwarzmann et al. | 416/193 A |
| 4,505,642 | 3/1985 | Hill | 416/193 |
| 4,516,910 | 5/1985 | Bouiller et al. | 416/190 |
| 4,743,164 | 5/1988 | Kalogeros | 416/193 |
| 4,872,810 | 10/1989 | Brown et al. | 416/145 |
| 4,872,812 | 10/1989 | Hendley et al. | 416/190 |
| 5,156,528 | 10/1992 | Bobo | 416/190 |
| 5,228,835 | 7/1993 | Chlus | 416/193 |
| 5,415,526 | 5/1995 | Mercadante | 416/190 |
| 5,460,489 | 10/1995 | Benjamin et al. | 416/248 |
| 5,513,955 | 5/1996 | Barcza | 416/95 |
| 5,785,499 | 7/1998 | Houston et al. . | |

*Primary Examiner*—Anthony Knight
*Assistant Examiner*—John L. Beres
*Attorney, Agent, or Firm*—Mark Steinberg

[57] ABSTRACT

A seal for a turbine blade in a gas turbine engine has a sealing portion with two subportions, where the subportions are longitudinally offset from one another, so that the seal may provide sealing for adjacent turbine blades having longitudinally offset inner platform surfaces. The offset between the sealing subportions should correspond generally to the offset between the platform surfaces.

30 Claims, 12 Drawing Sheets

TURBINE BLADE PLATFORM SEAL

DESCRIPTION

1. Technical Field

The invention relates to gas turbine engines and more particularly to seal configurations for turbine rotors.

2. Background Art

A typical gas turbine engine has an annular axially (longitudinally) extending flow path for conducting working fluid sequentially through a compressor section, a combustion section, and a turbine section. The turbine section includes a plurality of blades distributed among one or more rotating turbine disks. Each blade has a platform, a root and an airfoil. The root extends from one surface of the platform, and the airfoil projects from an opposing surface. The airfoil extracts energy from the working fluid. The turbine disk has a series of perimeter slots, each of which receives a blade root, thereby retaining the blade to the disk. The blade extends radially from the disk, with the root radially inward and the airfoil radially outward. The perimeter slots are spaced so as to provide an axially extending gap between adjacent blade platforms, which keeps the blade platforms from contacting and damaging each other.

Problems can arise from leakage of the working fluid into the gap between adjacent blade platforms. Once in the gap, the working fluid can leak into an area beneath the radially inner surfaces of the platforms. The temperature of the working fluid in the turbine is generally higher than that which components beneath the platform can safely withstand for extended durations. In addition, the working fluid may contain and transport contaminants, such as by-products of the combustion process in the combustion section, beneath the platform. Once beneath the platform, contaminants can collect and heat up, causing corrosion and cracks. Furthermore, the leaking working fluid circumvents the airfoils, thus reducing the amount of energy delivered to the airfoils.

A seal is generally employed to reduce leakage. The seal is a flexible element, typically made of thin sheet metal, which is positioned across the gap, beneath and in proximity to the radially inner surfaces of adjacent blade platforms. The seal typically has a portion which generally conforms with that of the surfaces with which it is to seal.

It has been determined that the effectiveness of the seal, described above, is reduced in the event of offset between the radially inner surfaces of adjacent blade platforms. Such offset reduces the ability of the seal to conform to the surfaces and results in an increase in leakage. It also results in less support for the seal, making it more likely that the seal will experience undesired distortion, and thus leading to even higher leakage. One example of such offset results from an effort to position the blade airfoils in an optimum aerodynamic orientation, as set forth below.

It is desirable to have the orientation of the airfoil with respect to the root correspond with the operating characteristics of the other engine components. However, the exact operating characteristics of the engine components are not known until the initial engine is tested. Obviously, the engine, including the blades, must be fabricated before it can be tested, but the blades are fabricated by means of a casting process, i.e. molds, meaning that the molds are designed before the desired (optimum) orientation is known. Consequently, the molds generally do not provide the optimum orientation of the airfoil with respect to the root. Although the optimum orientation is subsequently determined upon testing the initial engine, the molds are generally not redesigned. Instead, subsequent blades are cast using the same molds and the roots of the cast blades are machined to attain the optimum orientation. Such machining, or the like, to attain a different relative orientation between the airfoils and the roots is commonly referred to as "staggering".

A problem with staggering is that it also results in a different orientation for the blade platforms. As cast and prior to staggering, there is no significant axial offset between the surfaces of adjacent blade platforms, however, upon staggering, an axial offset is created between the cast features of the platforms, particularly those features which are radially directed. While the radially outer surfaces of the platforms may be machined to eliminate the offset, the radially inner surfaces of the platforms are not machined because of the difficulty that would be involved with such an operation.

The axial offset, between the radially inner surfaces of the platforms, makes sealing more difficult. The traditional approach for sealing in the presence of the offset uses flat seals having dimensional allowances for staggering. Such an approach results in less support for the seal and reduces the ability of the seal to conform to the surfaces of the platform. While one might expect centrifugal force to force the seal into compliance with the offset platform surfaces, it has been determined that this does not occur unless the offset is insignificant. This is because the offset occurs between surfaces that extend in a radial direction and therefore, a considerable axially directed force, rather than a radially directed (centrifugal) force, is needed to force the seal into compliance with these surfaces. Ultimately, the traditional seal ends up unsuitably deformed and twisted, leading to even higher leakage. Consequently, a seal adapted to sealing in the presence of offset between radially inner surfaces of adjacent blade platforms is sought.

DISCLOSURE OF THE INVENTION

To overcome the problems described above, the seal of the present invention has a sealing portion with two subportions, where the subportions are longitudinally offset from one another, so that the seal may provide sealing for adjacent turbine blades having longitudinally offset inner platform surfaces, where each of the offset sealing subportions provides sealing to an associated one of the offset platform surfaces. The offset between the sealing subportions should correspond generally to the offset between the platform surfaces. Such a seal can achieve closer proximity to and greater conformity with the offset surfaces than that which can be achieved by previous seals. This provides improved sealing and reduces leakage. It also provides improved support for the seal which reduces undesired distortion, thereby maintaining seal effectiveness.

In the best mode embodiment, the seal comprises two sealing portions, each with offset subportions, so that the seal may accommodate staggered adjacent blade platforms having two sets of offset surfaces, one on the upstream side of the platforms and one on the downstream side. The offset between the sealing subportions is preferably created either by either making one of the subportions thicker than the other or by bending a sheet metal sealing portion whereby both of the offset subportions have substantially equal thickness. The seal may be joined to a damper to form a combined damper and seal, which permits better location of the seal but does not negatively affect damping, whereby the seal receives greater radial support and can provide sealing for a greater portion of the axial gap between the platforms.

BEST MODE EMBODIMENT FOR CARRYING OUT THE INVENTION

Some of the subject matter herein may be disclosed and/or claimed in the following copending applications: "Turbine Blade Damper and Seal", U.S. Ser. No. 08/671,462 and "Turbine Blade Damper and Seal", U.S. Ser. No. 08/773,017.

Figure 1:
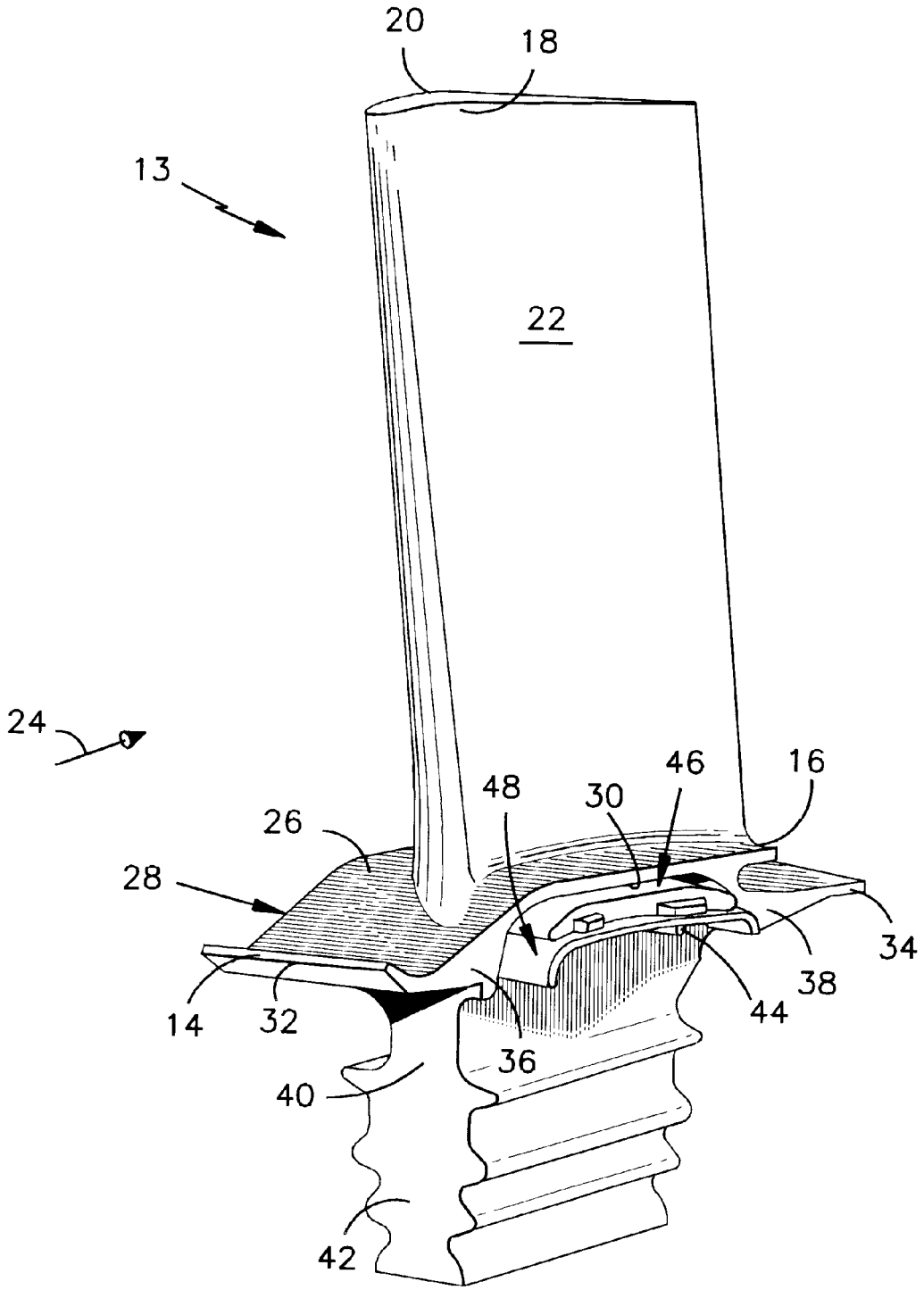
FIG. 1 is a perspective view of a turbine rotor blade and a damper and a first embodiment of the seal of the present invention.

The seal of the present invention is disclosed with respect to various embodiments for use with a second-stage, high pressure turbine rotor blade of the type illustrated in FIG. 1.

Referring to FIG. 1, a turbine rotor blade 13 has an upstream side 14, a downstream side 16, a concave (pressure) side 18, and a convex (suction) side 20. The blade 13 has an airfoil 22, which receives kinetic energy from a gas flow 24. The airfoil 22, which may be shrouded or unshrouded, extends from a radially outer surface 26 of a platform 28. The platform 28 has a radially inner surface 30, a leading edge 32 and a trailing edge 34.

The blade 13 further comprises a pair of platform supports 36, 38, a neck 40, and a root 42. The neck 40 is the transition between the platform 28 and the root 42. The root 42 is adapted to be inserted into a turbine rotor central disk (not shown) to attach the rotor blade to the disk. Here, the root 42 has a fir tree cross section. The neck 40 has a pair of protrusions 44 (only one shown) which are described and shown in further detail hereinbelow.

It will be understood that the rotor blade 13 is one of a plurality of such blades attached to the rotor disk (not shown). The blade 13 extends radially from the disk, with the root 42 radially inward and the airfoil 22 radially outward. Adjacent blade platforms are separated by an axially (longitudinally, i.e. the direction from the platform leading edge 32 to the platform trailing edge 34) extending gap, which keeps the blades platforms from contacting and damaging each other. The width of this gap should be large enough to accommodate the tolerances in the physical dimensions of the platforms including thermal expansion, and is preferably, on the order of about 0.04 inches.

Located beneath the radially inner surface 30 of the platform 28 is a damper 46 and seal 48 configuration. The damper 46 is a rigid element adapted to reduce blade-to-blade vibration, which consequently reduces individual blade vibration. The seal 48 is adapted to reduce leakage. The damper and the seal span across the gap between the platform 28 and the adjacent blade platform (not shown). The damper 46 and seal 48 are radially supported by the pair of protrusions 44 on the blade 13 neck 40.

Figure 2:
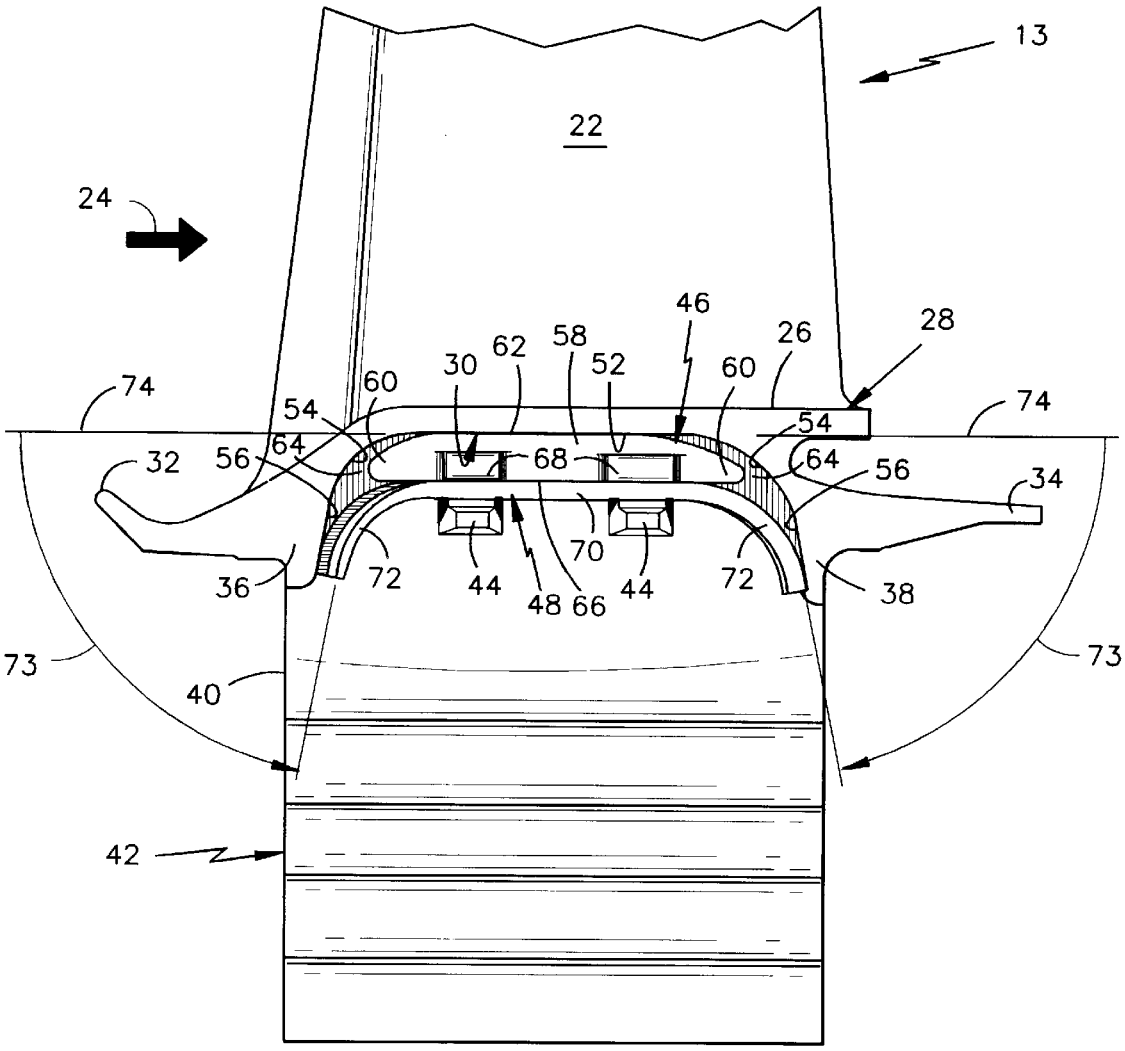
FIG. 2 is a fragmentary side view of the rotor blade, damper, and seal of FIG. 1.

Referring now to FIG. 2, the radially inner surface 30 of the blade platform 28 has a damping portion 52, a transition portion 54 and a sealing portion 56. The damping portion 52 has a substantially planar contour. The transition portion 54 comprises upstream and downstream fillet runouts, having substantially arcuate contour. The sealing portion 56 is generally located where sealing against leakage is sought, which for this blade 13, is in the proximity of the platform supports 36, 38. For most platform geometries, the sealing portion 56 is angled radially inward, typically at an angle of at least 45 degrees measured from the longitudinal axis, most often in the range of from about 60 degrees to 90 degrees. Geometries at the high end of this range, e.g., from about 75 to 90 degrees, are generally more difficult to seal against than those than at the low end, because the available sealing force, i.e. the component of centrifugal force directed perpendicular to the sealing portion, is less than that for geometries at the low end of the range.

The damper 46 comprises a main body 58 and a pair of extended ends 60. The main body 58 has a damping surface 62 in contact with the damping portion 52 of the platform radially inner surface 30. The damping surface 62 in combination with centrifugal force and the mass of the damper 46 and seal 48, provide the friction force necessary to dampen vibration. Generally, substantially uniform contact is sought between the surfaces 52, 62.

The extended ends 60 each have a proximal end, which transitions into the main body 58, and a distal end, which is free. The extended ends 60, which are tapered to accommodate stress, extend the damper 46 in the axial direction. Clearances 64, between the extended ends 60 and the transition portion 54 of the radially inner surface 30 of the platform 28, obviate interference between those parts to allow uniform continuous contact between the damping surface 62 and the damping portion 52 of the platform radially inner surface 30.

The damper 46 includes a radially inner support surface 66 which extends the length of the damper 46, opposite the damping surface 62, to provide support for the seal 48. The damper further comprises a pair of nubs 68 adapted to keep the damper 46 properly positioned with respect to the adjacent rotor blade (not shown).

The damper should comprise a material and should be manufactured by a method which is suitable for the high temperature, pressure and centrifugal force found within the turbine. It is further desirable to select a material which resists creep and corrosion under such conditions. A cobalt alloy material, American Metal Specification (AMS) 5382, and fabrication by casting, have been found suitable for high pressure turbine conditions.

The seal has a supported portion 70, in physical contact with the damper support surface 66, and a pair of sealing portions 72 adapted to seal against the sealing portion 56 of the platform radially inner surface 30. The shapes of the supported and sealing portions 70, 72 closely conform to that of the damper support surface 66 and sealing portion 56 of the platform radially inner surface 30, respectively. An arcuate bend at the transition between the supported portion 70 and the sealing portion 72 is preferred. Preferably, the bend has a radius which is greater than that of the transition portion 54 of the platform radially inner surface 30. To comply with most platform geometries, the sealing portions 72 typically extend from the supported portion at an angle 73 of at least 45 degrees, most often in the range of about 60 to 90 degrees, measured from the general plane 74 of the supported portion, neglecting any bend at the transition. The sealing portions 72 are effective even at the high end of this range, e.g., from 75 to 90 degrees to accommodate a generally similarly angled platform.

Each of the sealing portions has a proximal end, transitioning into the support portion 70 and a distal end, which is preferably free. The sealing portions 72 are preferably tapered to accommodate stress, gradually reducing in thickness from proximal end to distal end. The distal ends of the sealing portions 72 may be rounded. It is expected that centrifugal force will force the sealing portions of the seal into closer proximity with the sealing surfaces of the platform.

It should be recognized that the thickness of the seal 48 is generally not as great as that of the damper. This makes the seal more flexible, i.e. less rigid, than the damper, and thereby enhances the ability of the seal 48 to conform to the radially inner surface of the platform. However, in this embodiment, the seal 48 is generally thicker than traditional seals, which are typically comprised of a thin sheet of metal.

The seal 48 should comprise a material and should be manufactured by a method which is suitable for the high temperature, pressure and centrifugal force found within the turbine. It is further desirable to select a material which resists creep and corrosion under such conditions. The ductility, or pliability, of the seal 48 at elevated temperatures (about 1500 degrees for high pressure turbine applications) preferably approximates that of the traditional seal, which typically comprises a cobalt alloy material such as American Metal Specification (AMS) 5608 and which becomes stiffer, less pliable, at elevated temperatures. In this embodiment, a cobalt alloy material, American Metal Specification (AMS) 5382, and fabrication by casting, have been found suitable. However, any other suitable material and method of fabrication known to those skilled in the art may also be used.

Figure 3:
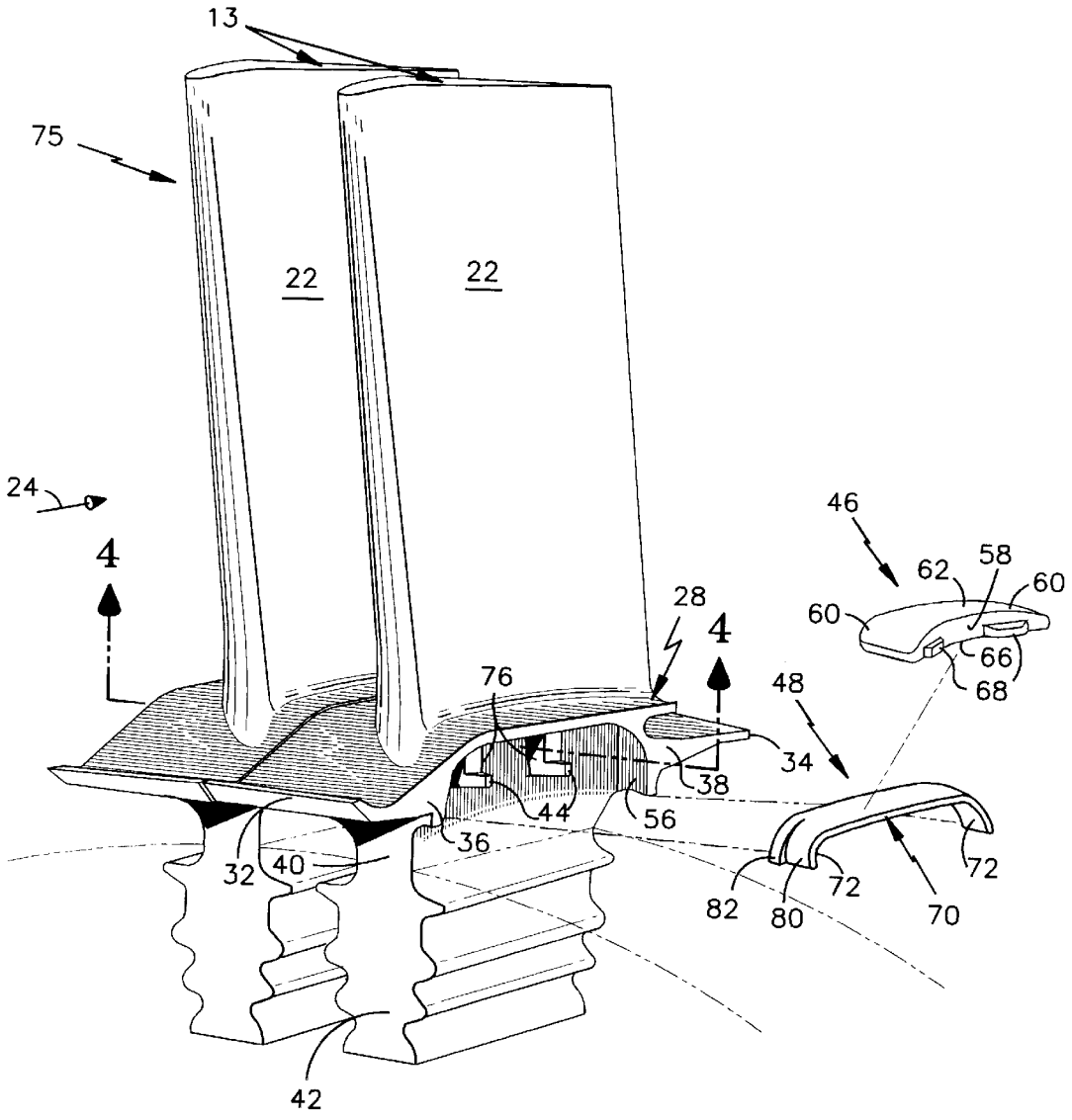
FIG. 3 is an exploded perspective view of two adjacent rotor blades in a staggered position and the damper and seal of FIG. 1.

Referring now to FIG. 3, a first pair 75 of adjacent rotor blades 13 each have a pair of stand-offs 76 (seen on one blade), which help keep the damper 46 and seal 48 in proper position with respect to the platform radially inner surface 30 and the neck 40. The pair 75 of blades are staggered, to optimally orient the airfoils 22 with respect to the roots 42. As a result of staggering, the platform surfaces on the pair 75 of blades are offset from one another, described hereinbelow with respect to FIG. 4.

Figure 4:
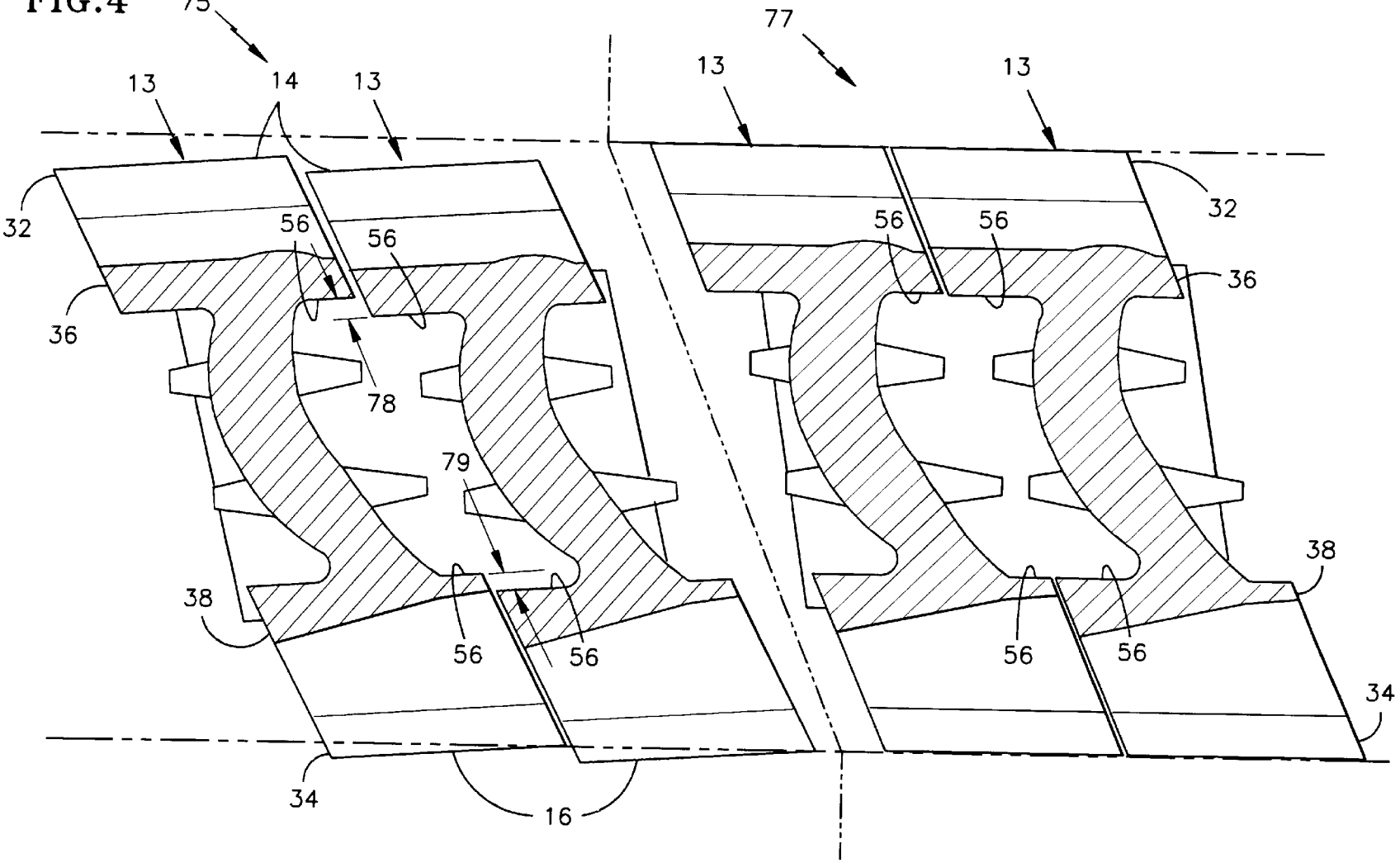
FIG. 4 is a cross section view, in the direction of 4—4, of the blades of FIG. 3 and another pair of adjacent rotor blades in a non-staggered position.

Referring now to FIG. 4, a second pair of blades 77 illustrate the relative orientation of adjacent blades as initially cast, i.e. without staggering. There is no offset between the radially inner surfaces of the second pair 77 of blade platforms, but the orientation of the airfoils 22 (FIGS. 1–3) on the second pair 77 with respect to the roots 42 (FIGS. 1–3) is not optimum. The staggering of the first pair 75 of blades provides optimum orientation, but results in axial offsets 78, 79 between the radially inner surfaces of the blade platforms. In particular, one axial offset 78 occurs between the sealing portions 56 of the radially inner surfaces 30 (FIGS. 1, 2) on the upstream side 14 (FIG. 1) of the blades 13, and another axial offset 79 occurs between the sealing portions 56 of the radially inner surfaces 30 (FIGS. 1, 2) on the downstream side 16 (FIG. 1) of the blades 13. The magnitude of the offset depends on the geometry and size of the blades and the amount of the stagger, where the amount of stagger is typically in the range of from about −4 degrees to about 4 degrees. For example, if the blade neck 40 (FIGS. 1–3) has an axial length of 1.6 inches and the amount of stagger is 2 degrees, then the magnitude of the offset is about 0.025 inches.

Until now, substantially flat and planar seals were used in such situations. However, it has been determined that the effectiveness of prior seals is significantly reduced in the event of offset between the sealing surfaces of adjacent blade platforms. Such offset reduces the ability of a planar seal to conform to the surfaces and results in an increase in leakage. It also results in less support for the seal, making it more likely that the seal will experience undesired distortion, leading to even higher leakage.

Referring again to FIG. 3, to accommodate the offset between the blades 75, each of the sealing portions 72 comprise two axially offset subportions 80, 82, each of which provide sealing to an associated one of the adjacent platform radially inner surfaces 30. In this view, only one of each of the subportions 80, 82 is visible on the seal 48 the other of the subportions 80, 82 are preferably substantially similar to the respective visible subportions 80, 82.

Figure 5:
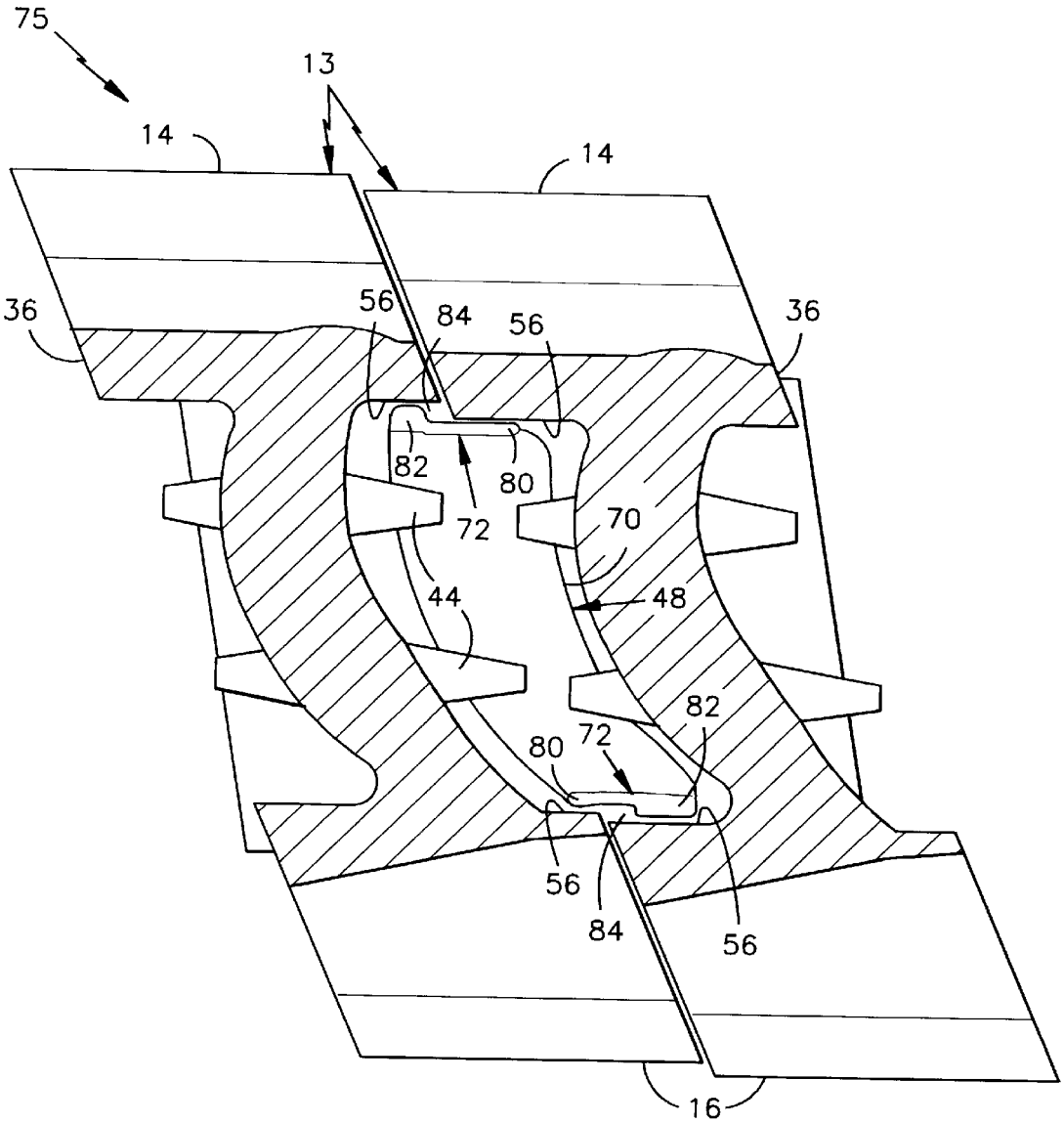
FIG. 5 is a cross section view, in the direction of 4—4, of the blades of FIG. 3, and the seal of FIG. 1 installed between them.

Referring now to FIG. 5, to accommodate the upstream axial offset 78 (FIG. 4), one subportion 82 on the upstream sealing portion of the seal 48 extends to the proximity of the upstream most radially inner surface. Similarly, to accommodate the downstream axial offset 79 (FIG. 4), one subportion 82 on the downstream sealing portion of the seal 48 extends to the proximity of the downstream most radially inner surface. Thus, the offset between the sealing subportions 80, 82 preferably corresponds to the offset between the radially inner sealing portion 56 of the platforms. This is preferably accomplished by providing the extended one of the subportions 82 with additional thickness compared to the other of the subportions 80, such that the radially outer surfaces of the subportions 80, 82 are not coplanar, i.e. the sealing portions 72 are preferably contoured. The radially inner surfaces of the subportions 80, 82 are preferably left substantially coplanar with each other, although, a similar offset between the radially inner surfaces of the subportions 80, 82 would increase seal ductility. As shown, the sealing portions 72 have a curvilinear step-like form, however, other suitable contours for the sealing portions 80, 82 will be obvious to those skilled in the art. Clearances 84 between the extended subportions 82 and the platform associated with the other of the subportions 80 obviate any interference between those parts. Without clearances, interference between the extended subportions 82 and the adjacent platform could cause the seal to become improperly positioned in relation to the radially inner surfaces and consequently degrade the sealing effectiveness.

Those of ordinary skill in the art should recognize that the damper 46 (FIGS. 1–3) and seal 48 have curved shapes to accommodate blade 13 considerations which are not relevant to the present invention.

The seal described above provides sealing portions that achieve closer proximity and can more closely conform to the offset surfaces of the platform. This improves sealing which reduces leakage and contamination, thereby increasing the reliability of the turbine. It also improves support for the seal which reduces undesired distortion, thereby maintaining seal effectiveness.

Figure 6:
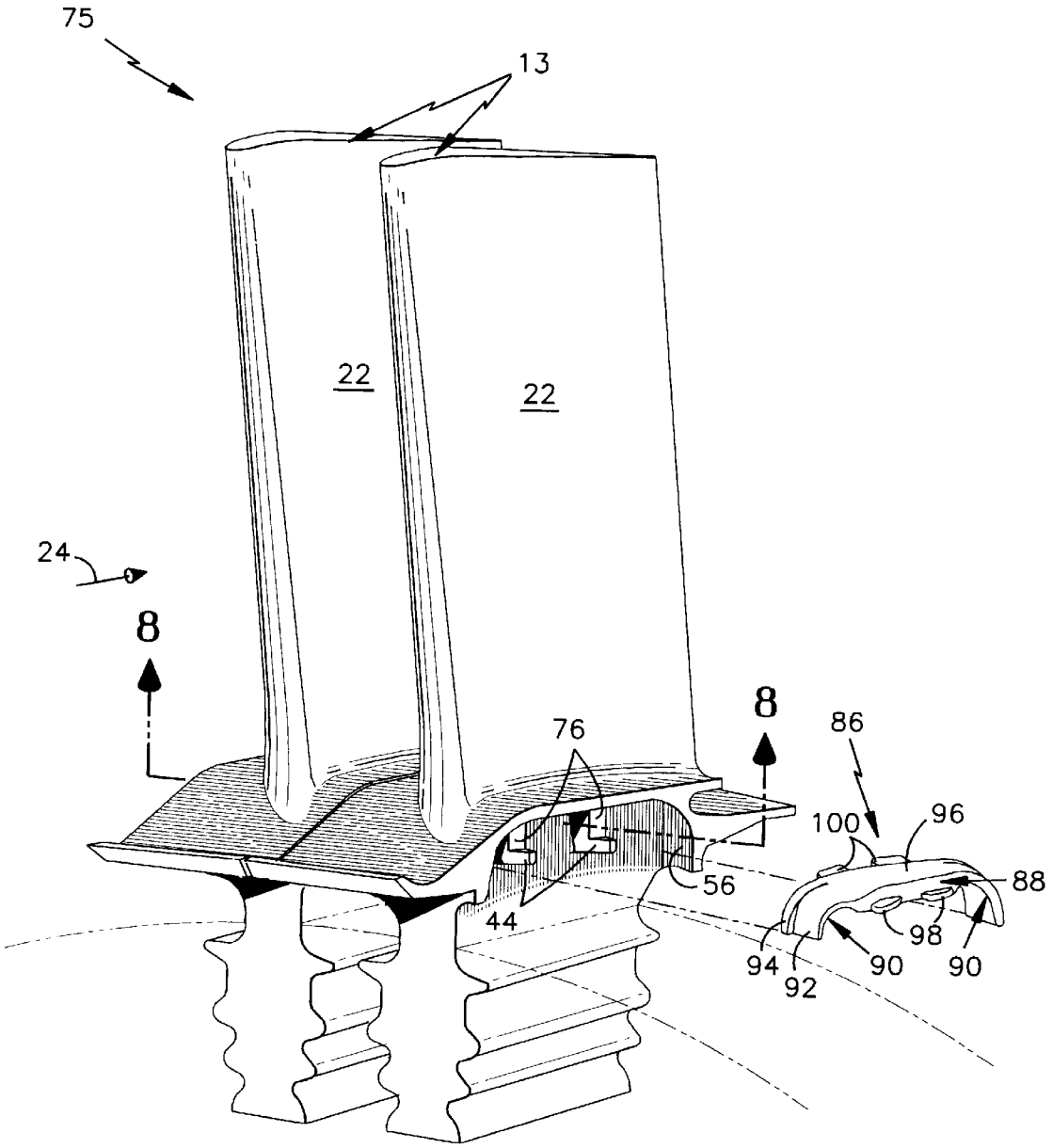
FIG. 6 is an exploded perspective view of the blades of FIG. 3 with a second embodiment of the seal of the present invention, wherein the seal is joined with a damper.

Referring now to FIG. 6, in a second embodiment of the present invention, a damper and seal combination 86, is comprised of a damper portion 88 and sealing portions 90, joined together by such means as brazing, or, to reduce cost, integrally fabricated as one piece as by casting. Machining, forging, rolling, and stamping, and combinations thereof, may also be used. The damper and sealing portions 88, 90 are similar to the main body 58 of the damper 46 and the sealing portions 72 of the seal 48, respectively, described above and illustrated in FIGS. 1–5. However, unlike the configuration above, these sealing portions 90 are not positioned radially inward of the damper portion 88, but rather, extend radially inward from the ends of the damper portion 88. Thus, the damper portion serves as the supported portion for the sealing portions 90. This provides better radial support for the seal compared to that provided by the first embodiment. The sealing portions 90 comprises axially offset subportions 92, 94 which are substantially similar to axially offset subportions 80, 82 respectively (FIGS. 3, 5). The damper portion 88 comprises a damping surface 96 and a first pair of nubs 98 which are similar to the damping surface 62 and the pair of nubs 68 (FIGS. 2, 3) of the first embodiment. The damper further comprises a second pair of nubs 100 that help keep the combined 86 damper and seal in proper position with respect to the radially inner surface 30 and the neck 40 of the blade 13.

Figure 7:
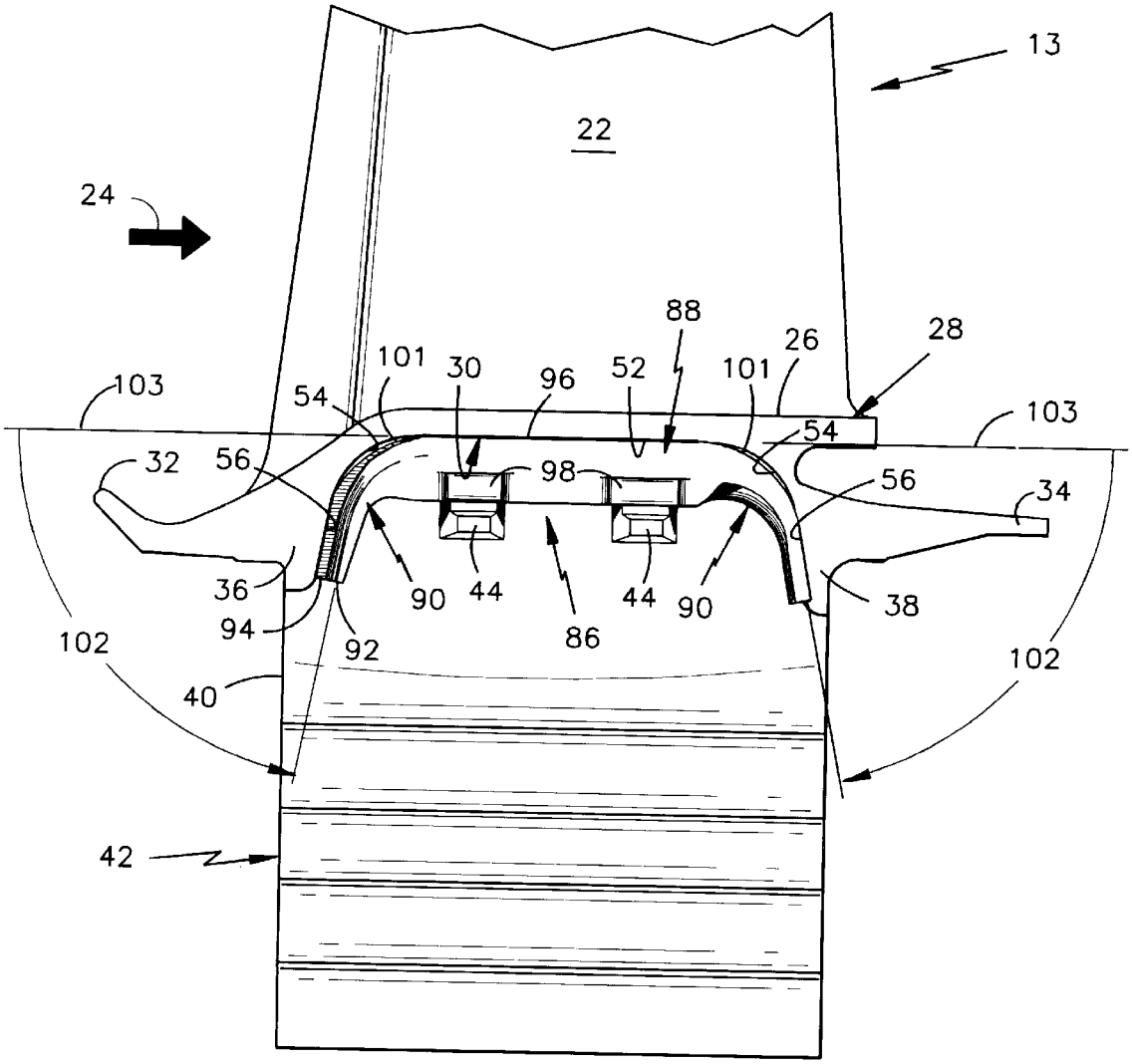
FIG. 7 is a fragmentary side view of the blade of FIG. 1 and the combined damper and seal of FIG. 6.

Referring now to FIG. 7, clearances 101 between the combination 86 and the transition portion 54 of the platform radially inner surface 30 function similar to but are smaller than the clearances 64 (FIG. 2) above for the damper 46 (FIGS. 1–5). Smaller clearances allow for better radial support for the sealing portions 90 and more effective sealing. When the engine is not operating, the combined damper and seal fits loosely beneath the platform. Upon engine startup, contact to the platform radially inner surface is preferably realized first by the damper portion 88 and then by the sealing portions 90. The sealing portions 90 should be flexible enough to prevent undesired interaction with the radially inner surfaces 30 which might otherwise interfere with the contact between the damping surface 96 of the damper portion 88 and the damping portion 52 of the platform radially inner surface 30. To comply with most platform geometries, the sealing portions 90 typically extend from the damper portion 88 at an angle 102 of at least 45 degrees, most often in the range of about 60 to 90 degrees, measured from the general plane 103 of the damper portion, neglecting any bend at the transition. The sealing portions 90 are effective even at the high end of this range, e.g., from 75 to 90 degrees to accommodate a generally similarly angled platform.

Figure 8:
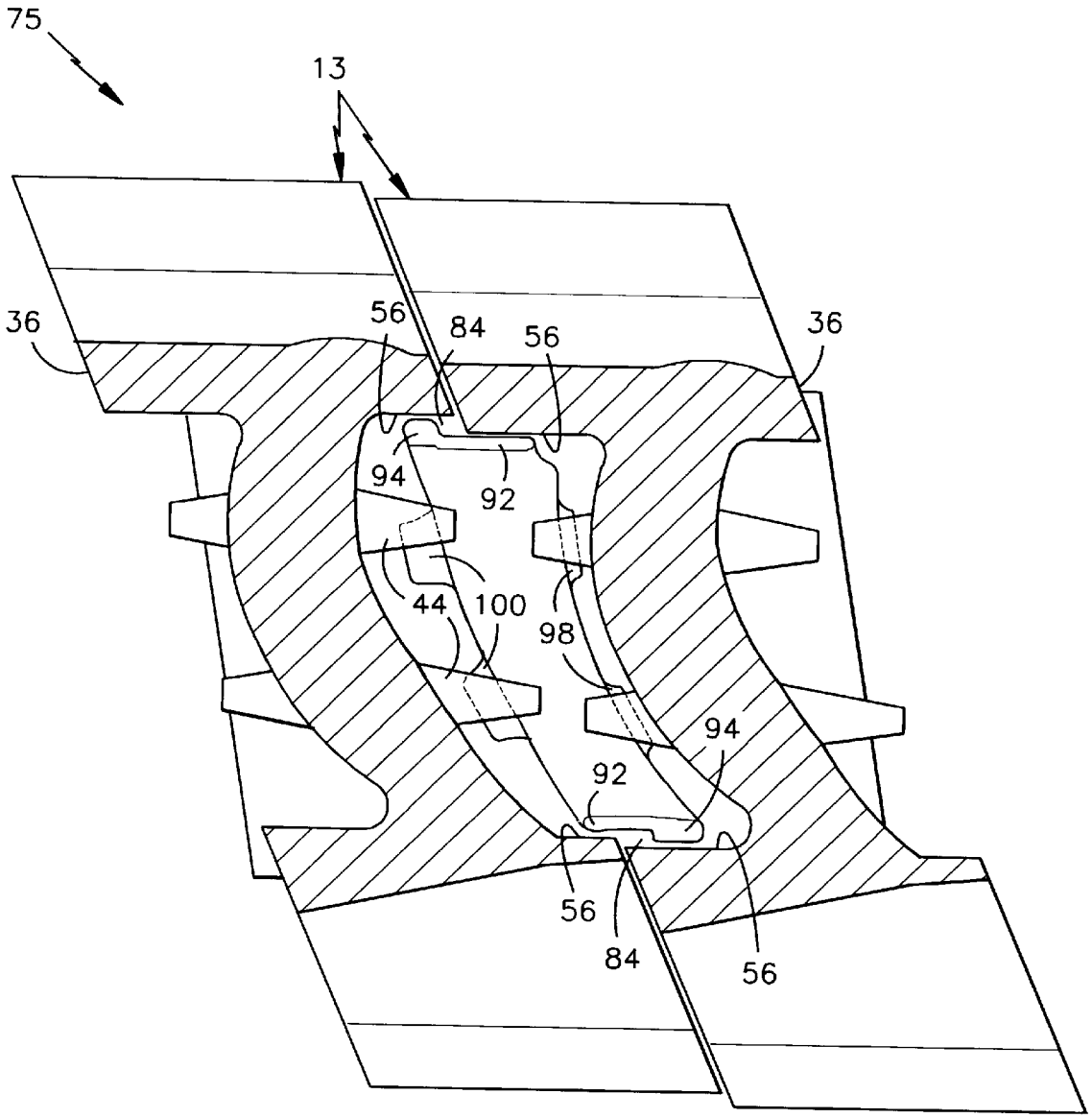
FIG. 8 is a cross section view, in the direction of 8—8, of the rotor blades of FIG. 6 with the combined damper and seal of FIG. 6 installed between them.

Referring now to FIG. 8, the sealing subportions 92, 94 accommodate the axial offset 78, 79 (FIG. 4) between the sealing portions 56 of the blade platform. Clearances 84 obviate interference as described above with respect to FIG. 6 As with the first embodiment, the combined damper and seal provides sealing portions that achieve closer proximity and can more closely conform to the offset surfaces of the platform. This improves sealing which reduces leakage and contamination, thereby increasing the reliability of the turbine. It also improves support for the seal which reduces undesired distortion, thereby maintaining seal effectiveness.

Figure 9:
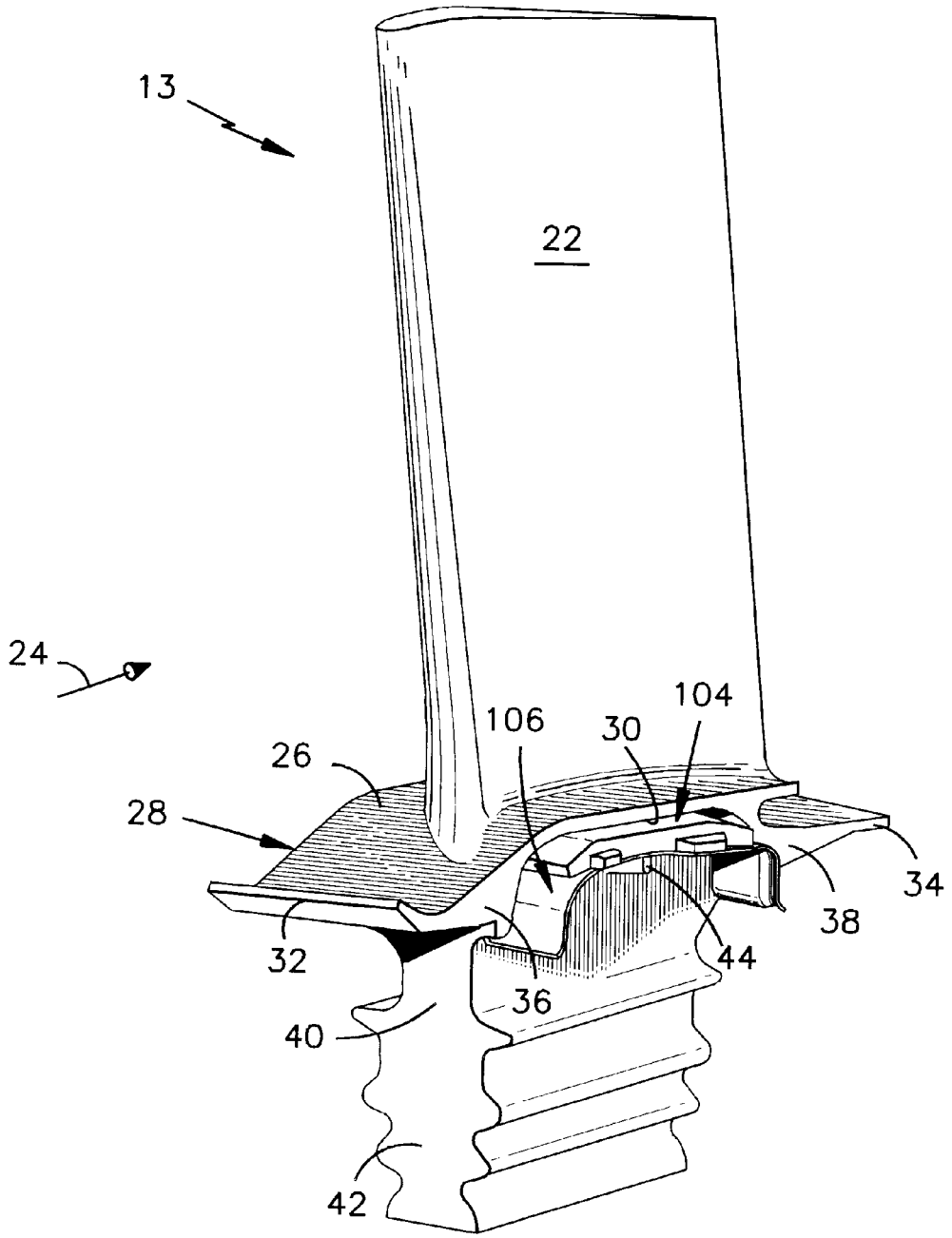
FIG. 9 is a perspective view of the rotor blade of FIG. 1 and a damper and a third embodiment of the seal of the present invention.
Figure 10:
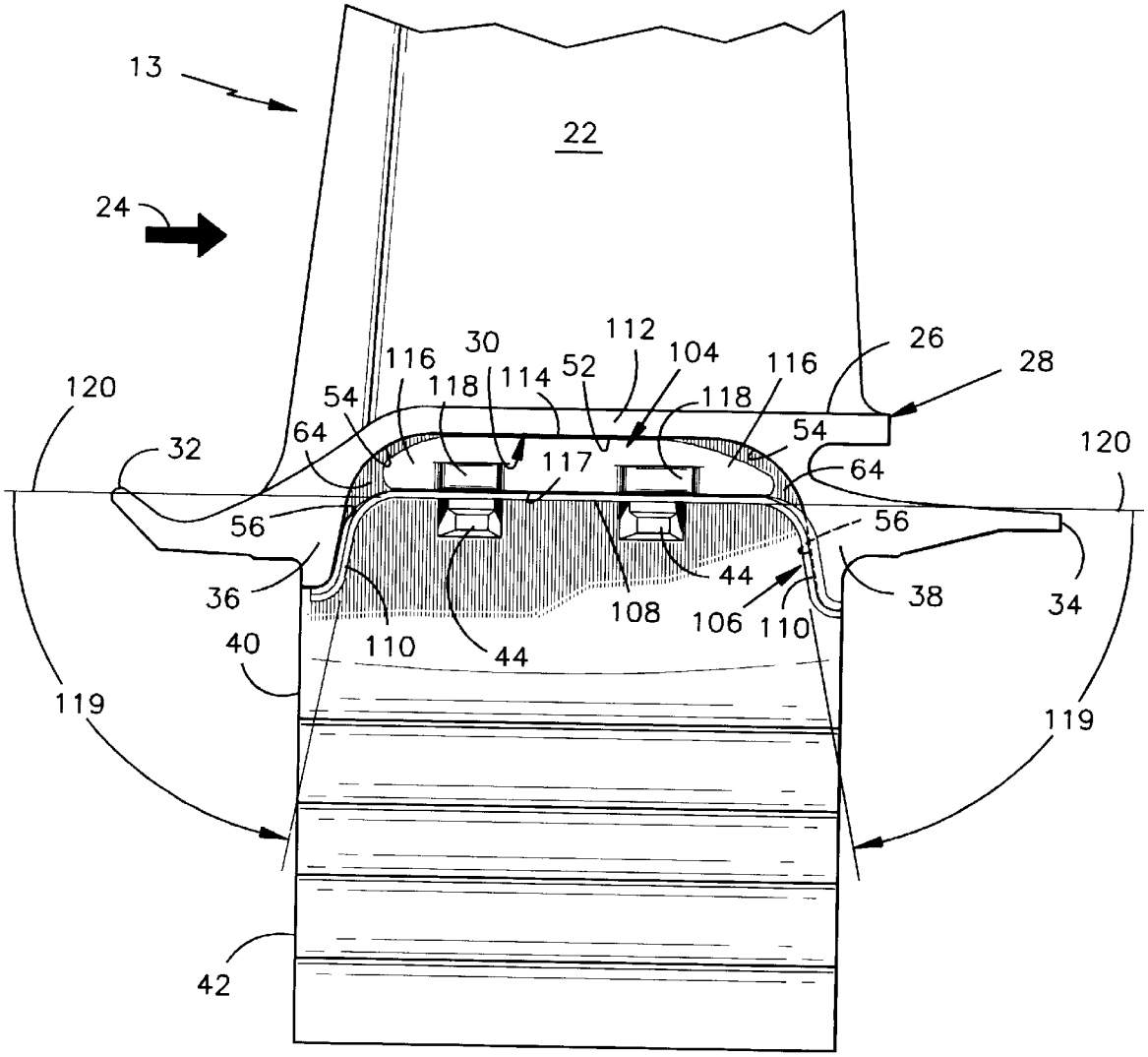
FIG. 10 is a fragmentary side view of the rotor blade, damper and seal of FIG. 9.

Referring now to FIGS. 9 and 10, in a third embodiment of the present invention, a damper 104 and a seal 106 are similar to the damper 46 and the seal 48 of the first embodiment except that the seal 106 is made of a thin sheet of metal, preferably a cobalt alloy material, such as American Metal Specification (AMS) 5608, and is cut by laser, to a flat pattern. A punch and die is then used to form the rest of the seal shape. The seal 106 has a supported portion 108 and a pair of sealing portions 110. The damper 104 has a main body 112, a damping surface 114, extended ends 116, a support surface 117, and a pair of nubs 118. To comply with most platform geometries, the sealing portions 110 typically extend from the supported portion 108 at an angle 119 of at least 45 degrees, most often in the range of about 60 to 90 degrees, measured from a general plane 120 of the supported portion, neglecting any bend at the transition. The sealing portions 110 are effective even at the high end of this range, e.g., from 75 to 90 degrees to accommodate a generally similarly angled platform.

Figure 11:
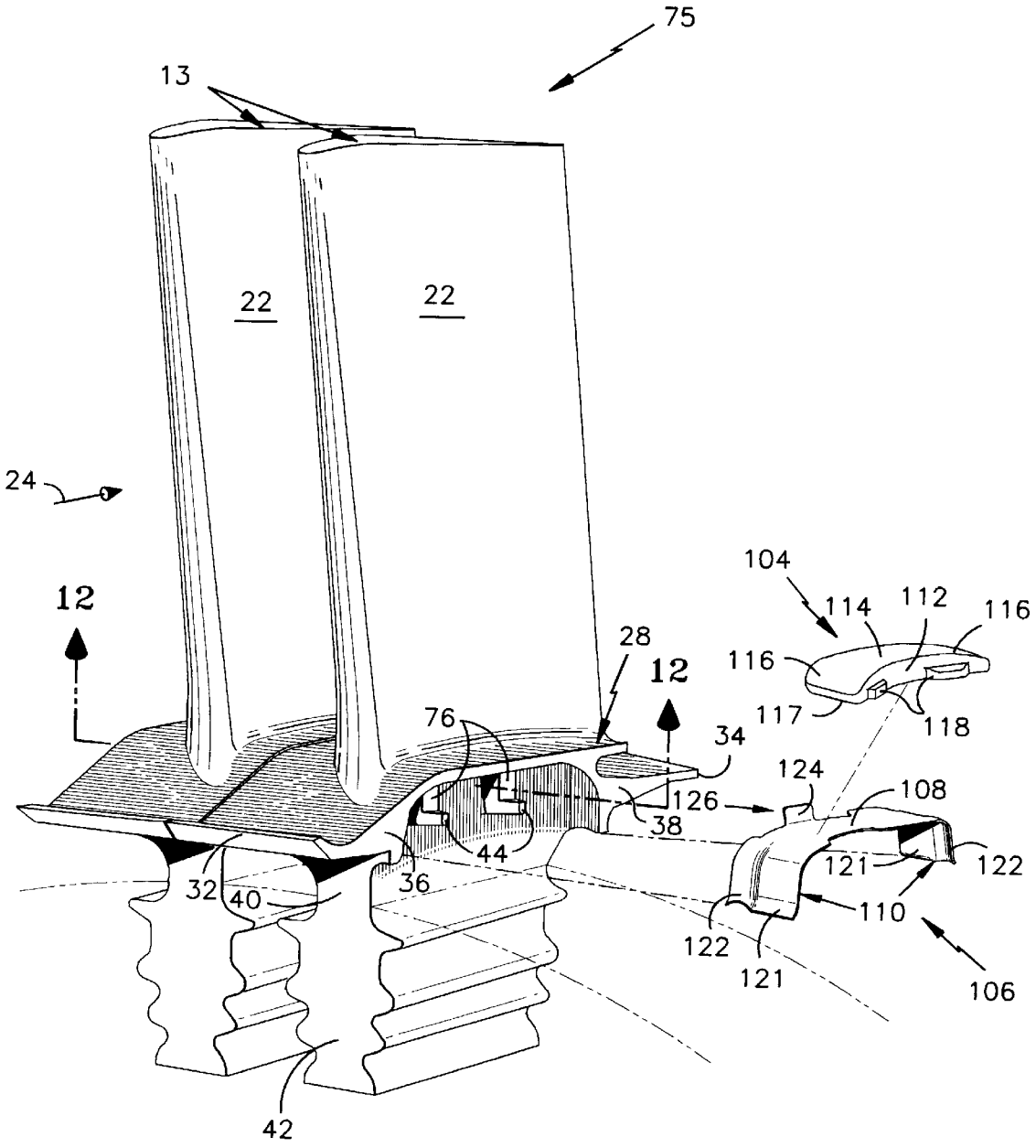
FIG. 11 is an exploded perspective view of the blades of FIG. 3, and the damper and seal of FIG. 9.

Referring now to FIG. 11, offset sealing subportions 121, 122 are preferably formed by bending and are of substantially equal thickness. While not relevant to the present invention, a projection 124 from the supported portion 108 preferably provides physical interference if the seal 106 is not properly installed, e.g., if the seal 106 is installed between the damper 104 and platform radially inner surface 30; however, when the damper and seal are installed properly, the projection 124 does not reach the damping surface 52 and therefore does interfere with damping. The seal 106 preferably has a locator 126, here a notch or a scallop, which interfaces with the stand-offs 76 to hold the seal 48 in the desired axial position.

Figure 12:
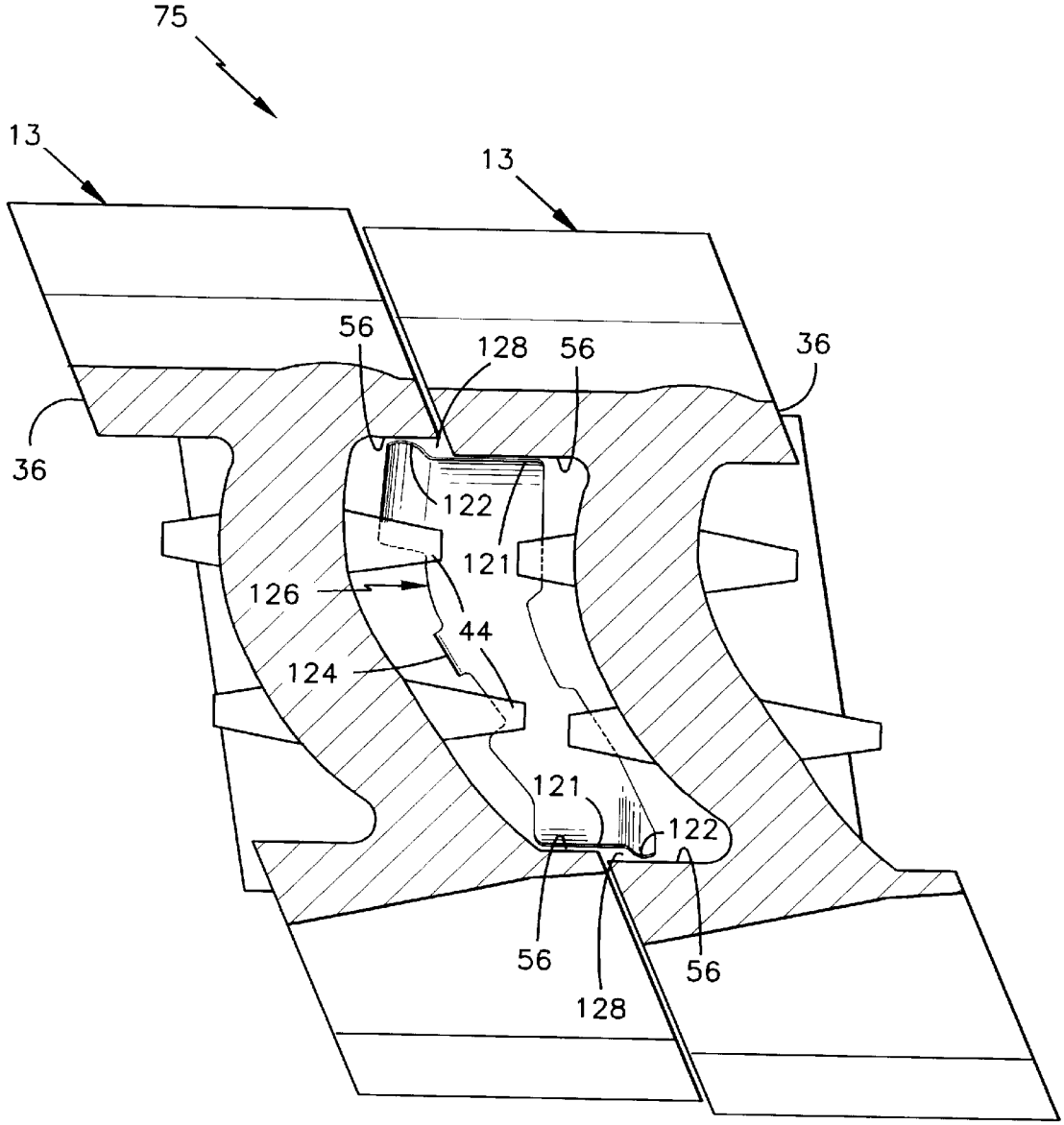
FIG. 12 is a cross section view, in the direction of 12—12, of the blades of FIG. 11, with the seal of FIG. 9 installed between them.

Referring now to FIG. 12, the offset sealing subportions 121, 122, accommodate the axially offset 78, 79 (FIG. 4) sealing portions 56 of the platforms. As shown, the sealing portions 110 have a bend with a curvilinear step-like form, however, other suitable contours, including but not limited to a hook-like shape, will be obvious to those skilled in the art. Clearances 128 between the extended sealing subportions 122 and the platform associated with the other of the subportions 121 obviate any interference between those parts.

As with the first and second embodiments, the seal 106 achieves closer proximity and can more closely conform to the offset surfaces of the platform. This improves sealing which reduces leakage and contamination, thereby increasing the reliability of the turbine. It also improves support for the seal which reduces undesired distortion, thereby maintaining seal effectiveness.

While the seal of the present invention is disclosed as having two similar sealing portions, each with subportions offset from one another, some applications may require only one sealing portion or more than two sealing portions. Further, the sealing portions need not be similar, e.g., one of the sealing portions may not have offset subportions, or may have more offset subportions than the other. Moreover, although the seal of the present invention is shown with a substantially planar supported portion, the sealing portions may be used on a seal having any suitable shape.

Although shown along with a damper, the seal of the present invention may be used with a different damper, or, with no damper at all, whereby the seal would be radially supported by the blade platform. Furthermore, the seal may be located anywhere and oriented in any manner appropriate, including radially outward of a damper. Any suitable means may be used to retain the seal in place.

Those skilled in the art should also recognize that although the seal is disclosed for use with staggered radially inner surfaces, which are offset axially from one another, other types of rectilinear and/or angular offsets may also be accommodated by the present invention. Such offsets are not limited to offsets that result from staggering the blades. Furthermore, the offset between the sealing subportions need not correspond exactly to the offset between the radially inner sealing surfaces of the platform. In fact, if the seal is formed by casting, then mismatch of about 0.015 inches is expected due to fabrication imprecision. Improvement, albeit lesser, may be achieved so long as there is some general correspondence in the offsets. Depending on the size of the offset and the application, the correspondence may only need to be 50% or 25%, or possibly smaller, to achieve adequate seal performance.

In the best mode embodiment, the offset between the subportions is in the range of from about 0.010 inches to about 0.040 inches.

While the particular invention has been described with reference to various embodiments for use in a second stage high pressure turbine application, this description is not meant to be construed in a limiting sense. The present invention may be suitably adapted for other applications, including but not limited to other turbine applications having different blade and platform geometries than that described. It is understood that various modifications of the above embodiments, as well as additional embodiments of the invention, will be apparent to persons skilled in the art upon reference to this description, without departing from the spirit of the invention, as recited in the claims appended hereto. It is therefore contemplated that the appended claims will cover any such modifications or embodiments as fall within the true scope of the invention.

What is claimed is:

1. A seal for a turbine rotor blade in a gas turbine engine, the engine having a longitudinal axis, each blade having a platform with an upstream side and a downstream side, the radially inner surface of said platform having a sealing portion, the sealing portions of adjacent blade platforms further being longitudinally offset from one another, the seal comprising:

a supported portion and a general plane relative to said supported portion; and at least one sealing portion having at least two subportions longitudinally offset from one another, said offset between said subportions generally corresponding to the offset between the adjacent blade platforms, each subportion sealing with the sealing portion of a associated one of the offset adjacent platform radially inner surfaces;

wherein said sealing portion extends at an angle relative to said general plane, said angle being in the range of from 45 degrees to 90 degrees.

2. The seal according to claim 1 wherein one of said at least two subportions is substantially thicker than the other.

3. The seal according to claim 1 wherein said sealing portion has a contour which is substantially step-like.

4. The seal according to claim 1 wherein said subportions have substantially the same thickness as each other and said sealing portion has a bending contour between said subportions.

5. The seal according to claim 1 wherein said angle is in the range of from about 75 degrees to 90 degrees.

6. The seal according to claim 1 wherein said offset between said subportions is in the range of from about 0.010 inches to about 0.040 inches.

7. The seal according to claim 1 wherein there are two of said sealing portions, one being an upstream sealing portion for sealing to offset radially inner surfaces on the upstream side of the adjacent platforms, the other of said two sealing portions being a downstream sealing portion for sealing offset radially inner surfaces on the downstream side of the adjacent platforms.

8. The seal according to claim 7 wherein each of said two sealing portions has two subportions.

9. The seal according to claim 8 wherein one of said two subportions of said upstream sealing portion is substantially thicker than the other subportion, and one of said two subportions of said downstream second sealing portion is substantially thicker than the other subportion.

10. The seal according to claim 9 wherein said angle is in the range of from about 75 degrees to 90 degrees.

11. The seal according to claim 10 wherein said offset between said subportions is in the range of from about 0.010 inches to about 0.040 inches.

12. The seal according to claim 8 wherein said at least two subportions have substantially the same thickness as each other and said sealing portion has a bending between said subportions.

13. The seal according to claim 12 wherein said angle is in the range of from about 75 degrees to 90 degrees.

14. The seal according to claim 13 wherein said offset between said subportions is in the range of from about 0.010 inches to about 0.040 inches.

15. The seal according to claim 1 wherein said angle is in the range of about 60 degrees to 90 degrees.

16. Apparatus for use in a gas turbine engine, the engine having a longitudinal axis, the apparatus comprising:

adjacent turbine rotor blades each having a platform with an upstream side and a downstream side, each platform further having a radially inner surface with a sealing portion angled radially inward, the sealing portion of the platform of one of the adjacent blades further being longitudinally offset from the sealing portion of the platform of the other of the adjacent blades; and a seal having at least one sealing portion with at least two subportions each having a radially outer surface, the radially outer surfaces of the subportions being longitudinally offset from one another, said offset between said radially outer surfaces of said subportions generally corresponding to the offset between the sealing portions of the platforms of the adjacent blades, each subportion sealing with the sealing portion of an associated one of the sealing portions of the platforms of the adjacent blades.

17. The apparatus according to claim 16 wherein said offset is provided by making one of said at least two subportions substantially thicker than the other.

18. The apparatus according to claim 16 wherein said sealing portion has a contour which is substantially step-like.

19. The apparatus according to claim 16 wherein said subportions have substantially the same thickness as each other and said sealing portion has a bending contour between said subportions.

20. The apparatus according to claim 16 wherein said seal further comprises a supported portion and a general plane relative to said supported portion, and wherein said sealing portion extends at an angle relative to said general plane, said angle being in the range of from 45 degrees to 90 degrees.

21. The apparatus according to claim 16 wherein said offset between said subportions has a size equal to at least 0.50 times that of said offset between said sealing portions of said adjacent blade platforms.

22. The apparatus according to claim 16 wherein there are two of said sealing portions each having two subportions, one of said sealing portions being an upstream sealing portion for sealing to offset radially inner surfaces on the upstream side of the platforms of the adjacent blades, the other of said two sealing portions being a downstream sealing portion for sealing offset radially inner surfaces on the downstream side of the platforms of the adjacent blades.

23. The apparatus according to claim 22 wherein said offsets are provided by making one of said two subportions of said upstream sealing portion substantially thicker than the other subportion of said upstream sealing portion, and one of said two subportions of said downstream second sealing portion substantially thicker than the other subportion of said downstream sealing portion.

24. The apparatus according to claim 23 wherein said seal further comprises a supported portion and a general plane relative to said supported portion, and wherein said sealing portions extends at an angle relative to said general plane, said angle being in the range of from 45 degrees to 90 degrees.

25. The apparatus according to claim 24 wherein said angle is in the range of about 60 degrees to 90 degrees.

26. The apparatus according to claim 24 wherein said offset between said subportions has a size equal to at least 0.50 times that of said offset between said sealing portions of said adjacent blade platforms.

27. The apparatus according to claim 22 wherein said at least two subportions have substantially the same thickness as each other and said sealing portion has a bending between said subportions.

28. The apparatus according to claim 27 wherein said seal further comprises a supported portion and a general plane relative to said supported portion, and wherein said sealing portions extends at an angle relative to said general plane, said angle being in the range of from 45 degrees to 90 degrees.

29. The apparatus according to claim 28 wherein said angle is in the range of about 60 degrees to 90 degrees.

30. The apparatus according to claim 28 wherein said offset between said subportions has a size equal to at least 0.50 times that of the offset between said sealing portions of said adjacent blade platforms.

* * * * *